US005344505A

United States Patent [19]

Ouyang et al.

[11] Patent Number: 5,344,505

[45] Date of Patent: Sep. 6, 1994

[54] NON-CHROMIUM PASSIVATION METHOD AND COMPOSITION FOR GALVANIZED METAL SURFACES

[75] Inventors: Jiangbo Ouyang, Bensalem; William L. Harpel, Langhorne, both of Pa.

[73] Assignee: Betz Laboratories, Inc., Trevose, Pa.

[21] Appl. No.: 107,383

[22] Filed: Aug. 16, 1993

[51] Int. Cl.[5] ..... C23C 22/07

[52] U.S. Cl. ..... 148/261; 148/275; 106/14.12

[58] Field of Search ..... 148/254, 261, 275, 253; 106/14.12

[56] References Cited

U.S. PATENT DOCUMENTS

| | | | |
|---|---|---|---|
| 2,493,516 | 1/1950 | Zimmer et al. | 148/261 |
| 3,468,724 | 9/1969 | Reinhold | 148/270 |
| 4,385,940 | 5/1983 | Kirihara et al. | 148/261 |

FOREIGN PATENT DOCUMENTS

| | | | |
|---|---|---|---|
| 2506349 | 8/1976 | Fed. Rep. of Germany | 148/259 |
| 56-005167 | 1/1981 | Japan | 148/261 |
| 60-208412 | 10/1985 | Japan | 148/261 |
| 4239096 | 8/1992 | Japan . | |
| 1359339 | 12/1987 | U.S.S.R. | 148/261 |
| 2041987 | 9/1980 | United Kingdom | 148/261 |
| 2070073 | 9/1981 | United Kingdom | 148/261 |
| 2259920 | 3/1993 | United Kingdom | 148/247 |

*Primary Examiner*—Anthony Green

*Attorney, Agent, or Firm*—Alexander D. Ricci; Steven D. Boyd

[57] ABSTRACT

A substantially chromium free composition and method for passivating a galvanized metal surface is disclosed. The passivation treatment which may be rinsed or dried-in-place includes phosphoric acid, boric acid and optionally molybdic acid.

6 Claims, No Drawings

NON-CHROMIUM PASSIVATION METHOD AND COMPOSITION FOR GALVANIZED METAL SURFACES

FIELD OF THE INVENTION

The present invention relates to a composition and method for passivating a galvanized coating on a metal substrate. More particularly, the present invention relates to a treatment of a galvanized or Galvalume (trademark of Bethlehem Steel Corporation) metal surface to inhibit corrosion without painting.

BACKGROUND OF THE INVENTION

The purposes of a formation of a chromate conversion coating on the surface of galvanized metal are to provide corrosion resistance, improve adhesion of coatings and for aesthetic reasons. Chromate passivation of a galvanized steel surface is done to provide corrosion resistance and for aesthetic reasons on materials which are not to be painted. A bulky, white corrosion product may form on an unprotected bright zinc surface when it becomes wet. This corrosion product is a mixture of zinc carbonate and zinc oxide or hydroxides resulting from zinc oxidation. The conditions producing the "humid storage" stain (so called white rust) most frequently occur in shipment and during storage, especially when daily temperature variations cause atmospheric water vapor to condense on a zinc surface. Likewise, black stains form on unprotected Galvalume. Galvalume is a trademark of the Bethlehem Steel Corporation for a zinc-aluminum galvanized coating over steel.

Chrome based passivation treatments are applied to galvanized metals and Galvalume to provide both long term and short term corrosion protection. A chromate treatment is typically provided by contacting galvanized metal with an aqueous composition containing hexavalent and trivalent chromium ions, phosphate ions and fluoride ions. Growing concerns exist regarding the pollution effects of the chromate and phosphates discharged into rivers and waterways by such processes. Because of the high solubility and the strongly oxidizing character of hexavalent chromium ions, conventional chromate processes require extensive waste treatment procedures to control their discharge. In addition, the disposal of the solid sludge from such waste treatment procedures is a significant problem.

Attempts have been made to produce an acceptable chromate free conversion coating for passivation of galvanized metal. Chromate free pretreatments based upon complex fluoacids and salts or metals such as cobalt and nickel are known in the art. U.S. Pat. No. 3,468,724 which issued to Reinhold discloses a composition for coating ferriferous and zinc metal which comprises a metal such as nickel or cobalt and an acid anion selected from the group sulfate, chloride, sulfonate, citrate, lactate, acetate and glycolate at a pH of from 0.1 to 4.

SUMMARY OF THE INVENTION

The present invention comprises a composition and method for treating the surface of galvanized metal to provide for the passivation of the metal surface. The coating formed by the present invention may be dried in place or rinsed. The method of the present invention comprises treating a galvanized metal surface with an aqueous treatment solution including phosphoric acid, boric acid, and optionally molybdic acid. The treatment solution is substantially free of chromium. By substantially free of chromium it is meant that no chromium is added to the system.

DETAILED DESCRIPTION OF THE PREFERRED EMBODIMENTS

The present inventors have discovered that a galvanized coating on metal can be passivated so as to provide corrosion resistance with a substantially chromium free treatment solution. As used herein, galvanized includes Galvalume® a trademark of Bethlehem Steel for zinc-aluminum galvanized metal.

The treatment solution of the present invention is an aqueous solution including phosphoric acid, boric acid and optionally molybdic acid. The treatment solution may be applied by any convenient means including spraying, dip-squeegeeing, flow coating, and roll coating.

The concentration ratios of the three components can vary depending upon the metal substrate and treatment requirements. The phosphoric acid concentration can range from about 0.5 to 50%, the boric acid concentration can range from about 0.1 to 5% and the molybdic acid concentration can range from 0 to about 0.5%. The preferred concentrations of each component are 2.0% of 75% phosphoric acid, 0.2% boric acid and 0.2% molybdic acid. It was found that baking or oiling treated metal articles can increase the passivity.

Baking is a process familiar to those skilled in the art wherein treated metals are heated to specific peak metal temperature. Oiling is the application of a protective oil coating to the treated metal surface to further control corrosion.

A typical treatment process employing the treatment solution of the present invention can include: cleaning the unpassivated galvanized metal or Galvalume with an alkaline or weak acid cleaner followed by ambient tap water rinsing, squeegeeing and applying the treatment solution at room temperatures. The cleaning and rinsing stages prior to treatment solution application may not be necessary if the metal surface is not heavily soiled.

The invention will now be further described with reference to a number of specific examples which are to be regarded as solely illustrative, and not as restricting the scope of the invention.

EXAMPLES

The treatment solution of the present invention was tested on hot dipped galvanized metal and Galvalume. Comparative tests were run with a commercial passivation treatment, Betz Permatreat 2510 available from Betz Laboratories, Inc., of Trevose, PA. Betz Permatreat 2510 includes hexavalent chromium, phosphoric acid and trivalent chromium.

The evaluation of the passivation treatment on galvanized metal and Galvalume was made through a series of tests known to one skilled in the art. A beaker condensation test was used which measures the tendency for white rust or discoloration to develop on vapor exposed metal surfaces. The less area where white rust or discoloration develops the better the passivation. In the test, the metal surface to be tested is placed over a 600 milliliter beaker without a spout. The beaker contains warm (49° to 54° C.) water to within ½" at the top. The beaker is allowed to cool for 24 hours (1 cycle).

The test panel is removed and inspected for corrosion or discoloration. The test is repeated by adding fresh warm water to the beaker and repeating the 24 hour cycle. "Stack testing" was employed which measures the tendency for white rust or discoloration to develop on wet packed metal surfaces. The results are checked every five day cycle. "Water immersion" testing was employed which measures the tendency for white rust or discoloration to develop on a metal surface immersed in deionized water at 49° C.

Beaker testing with Betz Permatreat 2510 resulted in no white rust or black stain formation after more than 10 cycles.

EXAMPLE 1

A series of solutions containing phosphoric acid, boric acid and molybdic acid were used to passivate Advanced Coating Technology (ACT) G-90 hot dipped galvanized metal. After cleaning with an alkaline cleaner at 55° C. for 10 seconds, rinsing with ambient tap water, squeegeeing and application of the treatment solution in a spin coater, the metal test panels were baked to peak metal temperatures of 230° C. and then cooled in air. The test panels were then subjected to the beaker condensation test described above. Table I summarizes the results.

TABLE I

| Passivation Results | | | | | | | | | | |
|---|---|---|---|---|---|---|---|---|---|---|
| TREATMENT | | | BEAKER CONDENSATION* | | | | | | | |
| $H_3PO_4$ (75%) (%) | Molybdic Acid (%) | Borax (%) | 1st | 4th | 7th | 10th | 16th (cycle) | 19th | 21st | 24th |
| 1.0 | 0.1 | 0.1 | 0 | 0 | 2 | 5 | 15 | 25 | 30 | 40 |
| 1.0 | 0.1 | 0.5 | 0 | 5 | 6 | 7 | 19 | 19 | 19 | 15 |
| 2.0 | 0.0 | 0.2 | 0 | 3 | 3 | 3 | 3 | 3 | 3 | 3 |
| 2.0 | 0.0 | 1.0 | 0 | 5 | 5 | 10 | 15 | 20 | 20 | 25 |
| 2.0 | 0.2 | 0.2 | 0 | 0 | 0 | 0 | 0 | 0 | 0 | 0 |
| 2.0 | 0.2 | 1.0 | 0 | 0 | 3 | 3 | 10 | 10 | 10 | 10 |
| Oiled after Passivation** | | | | | | | | | | |
| 1.0 | 0.1 | 0.1 | 0 | 0 | 0 | 0 | 1 | 2 | 2 | 2 |
| 1.0 | 0.1 | 0.5 | 0 | 0 | 0 | 1 | 3 | 3 | 3 | 3 |
| 2.0 | 0.2 | 0.2 | 0 | 0 | 0 | 0 | 0 | 0 | 0 | 0 |

*Rust area coverages are shown in the table. The numbers are in percentage.
**Castrol 924 HF oil was applied using draw-down bar #5.

EXAMPLE 2

The solutions described above in Table I were employed to treat nonchemically treated Galvalume test panels from National Steel. The preparation in testing methods were as described above. Table II summarizes the results.

TABLE II

| Beaker Condensation Test | | | | | | | | | |
|---|---|---|---|---|---|---|---|---|---|
| TREATMENT | | | BEAKER CONDENSATION* | | | | | | |
| $H_3PO_4$ (75%) (%) | Molybdic Acid (%) | Borax (%) | 1st | 7th | 8th | 9th (cycle) | 10th | 12th | 15th |
| 1.0 | 0.1 | 0.1 | 0 | 0 | 0 | 0 | 0 | 0 | 0 |
| 1.0 | 0.1 | 0.1 | 0 | 5 | 10 | 10 | 10 | 15 | 20 |
| 1.0 | 0.1 | 0.5 | 0 | 2 | 5 | 5 | 5 | 20 | 20 |
| 2.0 | 0.2 | 0.2 | 0 | 0 | 0 | 0 | 0 | 0 | 0 |
| Clean only | | | 100 | — | — | — | — | — | |
| 0.5% PT 2510 | | | 0 | 0 | 0 | 0 | 0 | 0 | 0 |
| 1.0% PT 2510 | | | 0 | 1 | 1 | 1 | 1 | 0 | 0 |

EXAMPLE 3

Stack and water immersion test as described above were performed on nonchemically treated Galvalume test panels from National Steel prepared in accordance with the description of Example 1. Table III summarizes the results.

TABLE III

| Stack and Water Immersion Tests | | | | | | |
|---|---|---|---|---|---|---|
| TREATMENT | | | | | BLACK STAIN AREA (%) | |
| $H_3PO_4$ (75%) (%) | Molybdic Acid (%) | Borax (%) | BAKED* | OILED** | STACK (5 cycles) | IMMERSION (700 hrs) |
| 2.0 | 0.2 | 0.2 | No | No | 0 | 3 |
| 2.0 | 0.2 | 0.2 | No | Yes | 2 | 0 |
| 2.0 | 0.2 | 0.2 | Yes | No | 5 | 0 |
| 2.0 | 0.2 | 0.2 | Yes | Yes | 0 | 0 |
| 1.0% PT 2510 | | | No | No | 0 | 0 |
| 1.0% PT 2510 | | | No | Yes | 0 | 0 |
| 1.0% PT 2510 | | | Yes | No | 5 | 5 |
| 1.0% PT 2510 | | | Yes | Yes | 0 | 0 |

*Peak metal temperature: 232° C.
**Castrol 924 HF oil, applied using draw-down bar #5

EXAMPLE 4

An outdoor exposure test was conducted on phosphoric acid/molybdic acid/borax passivated ACT G-90 galvanized metal test panels. The exposure was for a period of approximately 7 weeks during a relatively humid spring season. Panels treated with Betz Permatreat 2510 were tested side by side. The panel preparation was as described above in Example 1. The treatment solution consisted of 0.6% phosphoric acid, 0.2% molybdic acid, and 0.4% borax. Panels treated with Permatreat 2510 and the treatment solution of the present invention exhibited a similar appearance at the end of the seven week test period.

The results of Examples i through 4 show that the non-chromium treatment solution of the present invention provides passivation of galvanized metal and Galvalume comparable to a commercial chromium based passivation treatment.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for passivating a galvanized metal surface comprising contacting the galvanized surface with an aqueous, substantially chromium free, treatment solution consisting essentially of from about 0.5 to 50% phosphoric acid, and from about 0.1 to 5% boric acid.

2. The process of claim 1 wherein said treatment solution is baked on said galvanized metal at temperatures of up to about 300° C.

3. The process of claim 1 wherein said treatment solution further includes from about 0.1 to 0.5% molybdic acid.

4. A passivation treatment solution for galvanized metal consisting essentially of from about 0.5 to 5% phosphoric acid, from about 0.1 to 5% boric acid and from 0 to 0.5% molybdic acid wherein said treatment solution is substantially free of chromium.

5. A composition for passivating a galvanized metal surface consisting essentially of from about 0.5 to 50% phosphoric acid, from about 0.1 to 5% boric acid and from 0 to about 0.5% molybdic acid.

6. A process for passivating a galvanized metal surface comprising contacting the galvanized surface with an aqueous, substantially chromium free, treatment solution consisting essentially of from about 0.5 to 50% phosphoric acid, from about 0.1 to 5% boric acid, and from about 0.1 to 0.5% molybdic acid.

* * * * *